United States Patent [19]

Schill

[11] 4,211,165

[45] Jul. 8, 1980

[54] APPARATUS FOR THE COMPRESSIVE HANDLING OF A STRIP OF MATERIAL

[75] Inventor: Gottlob Schill, Reutlingen, Fed. Rep. of Germany

[73] Assignee: Bruderhaus Maschinen GmbH, Reutlingen, Fed. Rep. of Germany

[21] Appl. No.: 960,441

[22] Filed: Nov. 13, 1978

[30] Foreign Application Priority Data

Nov. 22, 1977 [DE] Fed. Rep. of Germany ..... 2752034

[51] Int. Cl.[2] ..... D21F 3/08; D21G 1/02

[52] U.S. Cl. ..... 100/162 R; 100/168; 162/272; 162/360 R

[58] Field of Search ..... 162/360 R, 305, 289, 162/272, 205, 139; 100/93 RP, 155 R, 158 R, 159, 161, 162 R, 168, 170, 163 A, 164; 34/117

[56] References Cited

U.S. PATENT DOCUMENTS

| | | | |
|---|---|---|---|
| 1,405,211 | 1/1922 | Haug | 162/305 |
| 1,493,536 | 5/1924 | Haug | 162/305 X |
| 1,789,515 | 1/1931 | Cram et al. | 162/289 X |
| 3,270,664 | 9/1966 | Veneman et al. | 100/162 R |
| 3,499,957 | 3/1970 | Ancker | 100/162 R X |
| 3,610,137 | 10/1971 | Brafford | 100/161 |
| 3,905,288 | 9/1975 | Holm | 100/162 R |
| 4,016,032 | 4/1977 | Kankaanpaa | 162/360 R X |

FOREIGN PATENT DOCUMENTS

| | | | |
|---|---|---|---|
| 232840 | 8/1963 | Austria . | |
| 111447 | 5/1899 | Fed. Rep. of Germany | 162/360 R |
| 2636887 | 3/1977 | Fed. Rep. of Germany . | |
| 546917 | 3/1974 | Switzerland . | |
| 747347 | 4/1956 | United Kingdom . | |
| 921296 | 3/1963 | United Kingdom | 162/305 |

OTHER PUBLICATIONS

Handbook of Paper and Cardboard Fabrication, Second Edition, 1926, pp. 609 and 839–843.

*Primary Examiner*—Richard V. Fisher
*Attorney, Agent, or Firm*—Wigman & Cohen

[57] ABSTRACT

Apparatus for the compressive handling of a strip of material, especially for handling paper strip in a paper machine, includes a plurality of cooperating horizontal and vertical roller pairs arranged in ascending and/or descending step-like succession and forming compressive zones through which the strip of material passes. Certain rollers are movably mounted so that they may be pivoted away from the compressive zone for replacement during operation of the paper machine. Cable guides are provided for leading the strip through the compressive zones and, owing to the movable mounting arrangement of the rollers, the course of the cable guides through the compressive zones need not be altered when a roller is exchanged.

10 Claims, 4 Drawing Figures

APPARATUS FOR THE COMPRESSIVE HANDLING OF A STRIP OF MATERIAL

BACKGROUND OF THE INVENTION

The present invention relates to a device for the compressive handling of a strip of material, especially a strip of paper, having at least four rollers arranged on parallel axes, which rollers cooperate in pairs. The rollers form at least one pair of vertical and one pair of horizontal rollers and at least one roller of each pair is movably mounted in such a way as to permit a change in the size of the space or compressive zone between two rollers.

In the known rolling devices, the introduction of the leading end of the strip of material usually takes place into the first compressive zone and the threading through the remaining compressive zones takes place in smoothing apparatus with the aid of a table guide, between the two cables of which the edges of the strip of material to be guided are clamped. It is disadvantageous in these known rolling devices, that the strip of material is not guided through all available roller pairs. To accomplish this, the cable guide must be modified to a new course before the introduction of the strip of material and this is expensive. A relatively great expense is also required by another known device for the introduction of the leading end of a strip of material into a smoothing device (DT-OS No. 2,636,887), because there is not only required a plurality of transport units having a conveyor belt and a suction box, but also the arrangement of these transport units requires changing if the course of the strip of material is to be changed.

SUMMARY AND OBJECTS OF THE INVENTION

The basic objective of the invention is to provide a device for the compressive handling of a strip of material with at least four pair of cooperating rollers which requires no modification of the cable guide provided for the lead-in of a strip of material when there is to be a change in the path of the material.

If one or more of the compressive zones is missing from the arrangement of rollers according to the invention, for example, because less than the maximum number of compressive zones is to be used or because individual rollers are removed or lifted for disassembly or replacement, then, instead of the generally S-shaped course of the material, one attains a straight path in the effective compressive zone, to which path the cable guide automatically adjusts as a result of the effective cable tension without any modification. This change in the path of the strip from an S-shape to a straight line and vice versa for the removal or addition of a compressive zone results in the further advantage that individual rollers can be removed during operation, without the device interfering with the passage of the strip of material. A roller exchange during operation is of particular significance if a portion of the rollers of the device are elastic rollers, since elastic rollers, such as paper-covered calender rollers or rollers covered with other elastic materials, such as rubber or plastic, must be replaced much more often than hard rollers. Frequent roller replacement has been a primary hindrance to the integration of calenders into paper machines, because during a roller exchange the entire paper machine has to be stopped. The roller arrangement according to the invention, in contrast, makes possible a roller replacement during operation. Therefore, with this type of roller arrangement a calender can be integrated into a paper machine. During a roller exchange, there is only a temporary loss of one of the compressive zones, which is insignificant in view of the relatively large number of compressive zones of a calender.

A further advantage of the arrangement of rollers according to the invention is that the position of the compressive zones can be changed without interrupting the continuous running of the strip of material, which results in the possibility of changing the arc of the strip wrap. A change of the arc of the strip wrap can be desirable for two reasons. The smoothness and the sheen of a paper strip are greatly influenced by the temperature of the contacted roller. At greater strip wrap arcs, the paper strip passes into the next compressive zone at a higher temperature. The fibers are, therefore, more compressible or even plastic in the subsequent compressive zone. Decreasing the arc of the strip wrap can be desirable if the strip of paper tends to form folds, such as can be the case with a large strip width, when the rollers bend or deflect in the compressive zone.

It is also advantageous that the device according to the invention is suitable for all types of rollers. The rollers can be hard or elastic. They can also be formed free of camber.

The steps formed by the rollers can all be in the same direction, that is, they can form an ascending or descending stair succession. Two successive steps can, however, also extend in opposite directions, which results in a generally U-shaped arrangement of rollers. For spatial reasons, a roller arrangement is advantageous in which the two oppositely directed steps are arranged between two rows of steps which extend in the same direction. In all cases, the mounts for the rollers can be arranged to provide support from beneath or to provide a suspended support.

BRIEF DESCRIPTION OF THE DRAWINGS

In the following the invention is described in greater detail with the aid of the exemplary embodiments shown in the drawing, wherein.

DETAILED DESCRIPTION OF A PREFERRED EMBODIMENT

Figure 1:
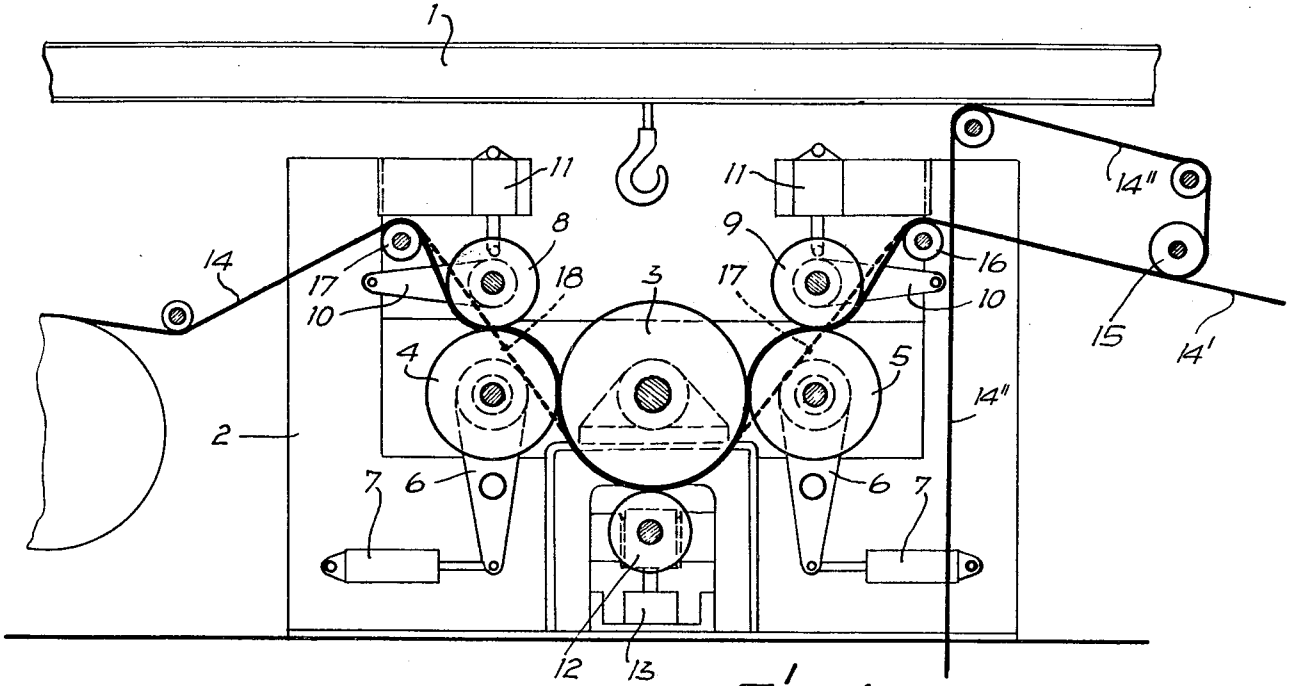
FIG. 1 is a schematically illustrated longitudinal section of a first exemplary embodiment of the invention integrated into a paper machine.

The smoothing device shown in FIG. 1 has a C-shaped roller frame 2 integrated into a paper machine, of which only an upper longitudinal rail 1 is shown. Above the center of the horizontally extending portion of the roller frame 2, a stationary axis horizontal roller 3 is mounted and comprises the center roller of the roller set. Together with this center roller 3, two rollers 4 and 5 the axes of which lie at the same elevation as the axis of roller 3 are arranged at the respective sides of the center roller 3 and each forming a roller nip constituting a compressive zone. The two rollers 4 and 5, which in the exemplary embodiment are formed identically, are each supported by two double-arm levers 6, which are mounted below the roller support in the roller frame 2 and are pivotable about a horizontal axis. A hydraulic cylinder 7 is connected to each of the downwardly directed lever arms 6, which hydraulic cylinders 7 are pivotably attached on their other ends to the roller frame 2. With the aid of the hydraulic cylinders, the rollers 4 and 5 can be pressed against the center roller 3 and can be pivoted a sufficient distance away therefrom to permit a roller exchange.

Above each of the two rollers 4 and 5, an additional roller 8 or 9 is arranged, which forms a respective compressive zone with the rollers 4 and 5. The two rollers 8 and 9, which in the exemplary embodiment are formed identically, are each mounted to an arm 10, each arm being pivotedly connected to the vertical shank portions of the roller frame 2. The end of each pivot arm 10 which supports the roller mount is articulatingly connected with a hydraulic cylinder 11 which is, in turn, connected to a horizontal shank extending from the top of the vertical shank portion of the roller frame 2. By means of the hydraulic cylinder 11, the force with which the rollers 8 and 9 are pressed against the rollers 4 and 5 can be adjusted to a desired value. In addition, the rollers 8 and 9 can be pivoted upwardly a sufficient distance away from the rollers 4 and 5 that they may be exchanged or replaced during operation without interfering with the passing strip of paper.

The rollers 8, 4 and 3, as shown in FIG. 1, form a first step, the rollers 3, 5 and 9 form a second step, the latter of which extends in a direction opposite the first step.

In addition to the rollers forming the step, an additional roller 12 may be arranged beneath the center roller 3. The additional roller 12 presses with the aid of hydraulic cylinder 13 against the underside of the roller 3 and can be sufficiently lowered with respect to the roller 3 to allow a roller exchange.

As shown in FIG. 1, the smoothing device is provided with a cable guide 14, with the aid of which the strip of paper is introduced, i.e., the leading edge of the paper is guided through the successive roller nips or compressive zones. The partially shown cable guide 14 has two parallel, guided endless cables 14' and 14". At the entrance side the two cables 14' and 14" are brought together at the paper lead roller 15 while the cable disc is loose. From this first lead-in roller 15, the two cables run toward a second roller 16 mounted in the roller frame 2 and then at an angle downwardly toward roller 9. They are then led together from the side of the vertical roller frame portion to which the pivot arms 10 are connected, between the rollers 9 and 5 and then downwardly between the rollers 5 and 3. Finally, the two cables are guided around the underside of the roller 3 and then upwardly between the roller 3 and 4. Then comes the guiding between rollers 4 and 8 as well as a deflection around a paper lead roller 17, which is arranged on the roller frame 2 outwardly and above the roller 8. The loose cable discs of the rollers, over which the cables pass in the area of the roller nips, are not shown.

If, for example, the rollers 4 and 8 are pivoted outwardly and upwardly, respectively, away from the roller 3, so that they have no effect on the strip of paper, or so that they can be exchanged, then the two cables 14' and 14" extend in a straight line along the dotted line 18 from the roller 3 to the guide roll 17. The corresponding result holds true if the rollers 5 and 9 are pivoted away in the same manner so that the cables extend along dotted line 17. The strip of paper can also pass through without changing the cable guide 14, when only the rollers 8 and/or 9 are pivoted away, that is, when only the compressive zones formed by the center roller 3 and the two rollers 4 and 5 are effective or are to be effected. The cables 14' and 14" then extend in a straight line from the roller 4 to the paper lead roller 17 or from the roller 5 to the paper lead roller 16.

Instead of the arrangement of the roller frame 2 shown in FIG. 1, a position rotated by 90° with regard to that shown, is possible as well as an arrangement rotated by 180°.

Figure 2:
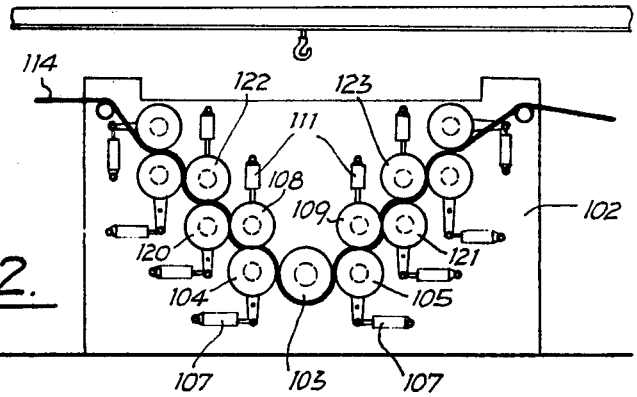
FIG. 2 is a schematically illustrated side view of a second exemplary embodiment.

In the exemplary embodiment of a calender as shown in FIG. 2, which can be integrated into a paper machine, as in the exemplary embodiment according to FIG. 1, a roller frame 102 carries a center roller 103, two adjacent rollers 104 and 105 arranged at the sides thereof and two rollers 108 and 109 arranged above these latter rollers in order to form two oppositedly directed steps. The rollers 103 and 108 and 109 are hard rollers, while the rollers 104 and 105 are elastic rollers. The latter are pivotable with the aid of hydraulic cylinders 107 in the manner of rollers 4 and 5 of the first exemplary embodiment. The rollers 108 and 109 are vertically adjustable and loadable with the aid of hydraulic cylinders 111.

Adjacent to and at the sides of the hard rollers 108 and 109, elastic rollers 120 and 121 are mounted to pivot arms, which are coupled with hydraulic cylinders. As shown in FIG. 2, a further roller 122 or 123 is arranged above each of the two rollers 120 and 121, which are vertically movable and loadable by hydraulic cylinders in the same manner as the rollers 108 and 109. The two rollers 122 and 123 are formed as hard rollers. After these latter two rollers, there follows elastic rollers which are arranged adjacent the sides thereof, above which, in turn, are arranged hard rollers. The elastic rollers are mounted to pivot arms in the same manner as the other elastic rollers, and the hard rollers are vertically adjustable and loadable with the aid of hydraulic cylinders.

The rollers form steps of a descending and an adjoining ascending staircase. The cable guide 114, just as that in the exemplary embodiment according to FIG. 1, does not need to be modified if one or more compressive zones are removed, because the removal of one compressive zone has only the result that, instead of an S-shaped path, a straight path of the cable is automatically established.

Figure 3:
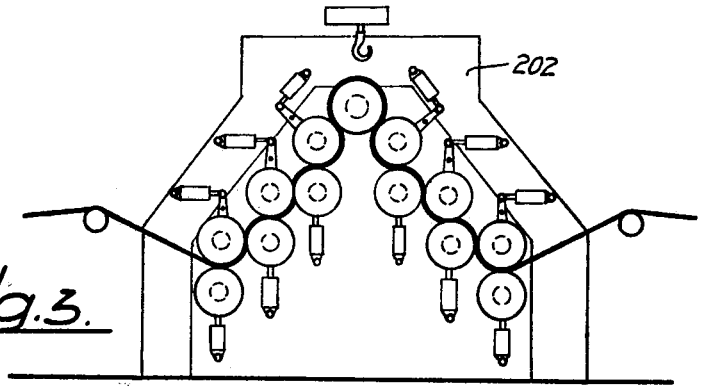
FIG. 3 is a schematically illustrated side view of a third exemplary embodiment.

Instead of a bottom supported arrangement of all rollers, as shown in FIGS. 1 and 2, a suspended arrangement can also be provided as shown in FIG. 3. The roller frame 202 then has the form of a bridge. As in the exemplary embodiment according to FIG. 2, the rollers are partially pivotally mounted and partially height-adjustably mounted and provided with hydraulic cylinders, which effect the compressive pressure and a shifting movement of the rollers.

Figure 4:
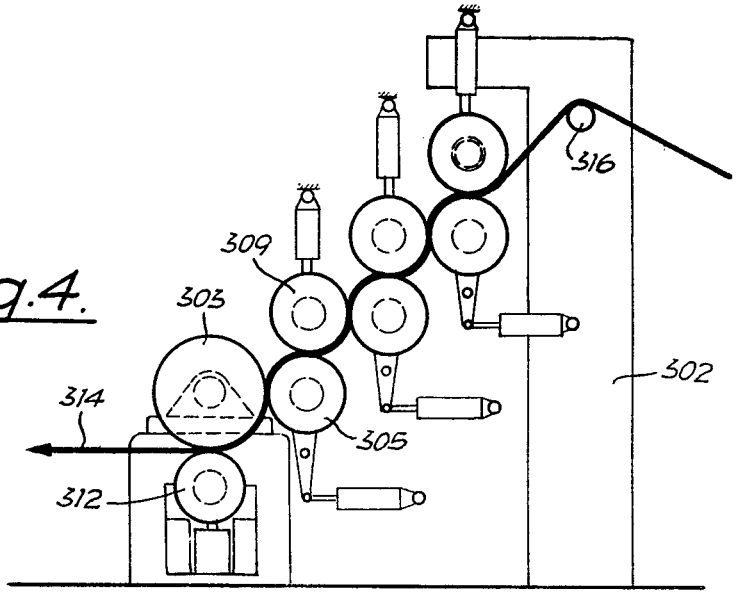
FIG. 4 is a schematically illustrated side view of a fourth exemplary embodiment.

The exemplary embodiment shown in FIG. 4 of a calender integrated into a paper machine can be viewed as one-half of the exemplary embodiment according to FIG. 2. The roller 103 corresponds to the roller 303 below which, as in the exemplary embodiment according to FIG. 1, an additional height-adjustable roller 312 can be mounted in the roller frame 302. At the sides next to the roller 303, an elastic roller 305 is arranged, corresponding to the roller 5 or 105, followed by a rigid or hard roller 309 bearing thereon. The remaining rollers are also arranged in steps, whereby a stair-like arrangement results, which consists exclusively of steps extending in the same direction. The cables of a cable guide 314 are led over a paper guide roller 316 which is mounted at the side and above the uppermost roller on the roller frame, from where, if all rollers are in operation, they run in undulating manner to the roller nip between the roller 303 and the additional roller 312, where they exit the calender. As in the other exemplary embodiments, the number of operational roller pairs can be changed at any time. Modification of the cable guide 314 is thus not necessary. Also, the lifting or pivoting away of one of the rollers during operation has no influence on the function of the calender.

To the extent that the roller 305 and the corresponding elastic rollers in the exemplary embodiment are not only movable in the horizontal direction, but also in the direction toward the space between the two neighboring rollers, that is, for the rollers 305, 303 and 309, the arc of the strip wrap can be changed in a simple manner. More specifically, all that need be done is to change the distance between two neighboring rollers. The intermediate roller, for example roller 305, can then extend inwardly to a greater or lesser degree between the two neighboring rollers 303 and 309.

In all exemplary embodiments, the rollers can also be shiftably mounted in a different manner, for example on movable slides. In addition, a number of rollers, for example, the pivotably mounted rollers in the exemplary embodiment according to FIG. 4 and/or the vertically adjustable rollers may be mounted in a common adjusting device so that they may then be raised and loaded in unison.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. An apparatus for the compressive handling of a strip of material, especially a strip of paper, comprising:

at least five rollers arranged on substantially parallel axes, said rollers being arranged to cooperate with each other in pairs;

means for movably mounting at least one roller of each pair so as to change the size of a compressive zone between two rollers;

said rollers being arranged to form at least two successive steps; and cable means for guiding the strip between rotational axes of each pair of rollers.

2. The apparatus according to claim 1, wherein said successive steps extend in the same direction.

3. The apparatus according to claim 1, wherein two of the successive steps extend in opposite directions.

4. The apparatus according to claim 3, further comprising:

a center roller arranged between two rollers of one roller pair.

5. The apparatus according to claim 4, wherein the rotational axis of the center roller is disposed at the height of the rotational axis of each of the two rollers of the one roller pair.

6. The apparatus according to claim 4, further comprising:

an additional roller associated with the center roller to form a pair of substantially vertically arranged rollers.

7. The apparatus according to claim 3, wherein the two oppositely directed successive steps are arranged between two rows of steps extending in the same direction as their respective adjacent oppositely directed successive step.

8. The apparatus according to claim 1, wherein said rollers are integrated in a paper machine.

9. The apparatus according to claim 1, wherein said rollers are arranged to cooperate in at least one pair of substantially vertical and one pair of substantially horizontal rollers.

10. The apparatus according to claim 1, wherein the cable means forms an S-shaped path for guiding the strip in an area where a compressive zone exists between two rollers of a roller pair and forms a straight path for guiding the strip in an area where a compressive zone is removed between two rollers of a roller pair whereby it is possible to service at least one of the two rollers during operation without interfering with the strip being guided by the cable means.

* * * * *